United States Patent [19]

Krasicky, Jr.

[11] Patent Number: 4,863,807

[45] Date of Patent: Sep. 5, 1989

[54] MULTI-LAYERED THERMAL INSULATING PISTON CAP

[75] Inventor: Stephen Krasicky, Jr., Greensboro, N.C.

[73] Assignee: Facet Enterprises, Inc., Tulsa, Okla.

[21] Appl. No.: 248,315

[22] Filed: Sep. 19, 1988

Related U.S. Application Data

[63] Continuation of Ser. No. 124,017, Nov. 23, 1987, abandoned.

[51] Int. Cl.[4] ..... F02F 3/12

[52] U.S. Cl. ..... 428/593; 428/608; 123/193 P; 92/224

[58] Field of Search ..... 123/193 P; 92/213, 222, 92/224; 428/608, 593, 596, 613, 685, 679, 678, 666, 662, 680, 668

[56] References Cited

U.S. PATENT DOCUMENTS

| | | | |
|---|---|---|---|
| 3,223,004 | 12/1965 | Sabo | 92/222 |
| 4,245,611 | 1/1981 | Mitchell et al. | 123/193 P |
| 4,254,621 | 3/1981 | Nagumo | 123/193 P |
| 4,334,507 | 6/1982 | Köhnert et al. | 164/120 |
| 4,531,502 | 7/1985 | Mizuhara | 123/193 P |
| 4,546,048 | 10/1985 | Guenther | 123/193 P |
| 4,550,707 | 11/1985 | Kervagoret | 123/193 P |
| 4,604,945 | 8/1986 | Mizuhara | 92/224 |

FOREIGN PATENT DOCUMENTS

| | | | |
|---|---|---|---|
| 41622 | 4/1978 | Japan | 92/222 |
| 15743 | 1/1983 | Japan | 123/193 P |
| 142037 | 7/1985 | Japan | 123/193 P |
| 20416 | of 1911 | United Kingdom | 123/193 P |
| 1560311 | 2/1980 | United Kingdom | 123/193 P |

*Primary Examiner*—John J. Zimmerman

*Attorney, Agent, or Firm*—Remy J. VanOphem

[57] ABSTRACT

A multi-layered insulating piston cap for cast metal pistons having an insulating, perforated metal sheet layer. A piston cap is provided having a top sheet continuous layer made of a heat and corrosion resistant metal for protecting the piston cap, a second layer made of heat and corrosion resistant metal sheet having a plurality of spaced apart perforations for providing trapped air spaces, a third layer made of a heat and corrosion resistant metal foil for sealing the perforations, and a fourth layer or porous, heat and corrosion resistant metal for anchoring the piston cap to the piston. One coined geometry can be used when blanking various sized cross-sections of piston cap.

8 Claims, 1 Drawing Sheet

MULTI-LAYERED THERMAL INSULATING PISTON CAP

This is a continuation, of application Ser. No. 124,017, filed Nov. 23, 1987 now abandoned.

BACKGROUND OF THE INVENTION

1. Field of the Invention

This invention relates to thermal insulating piston caps for internal combustion engines, more particularly to a multi-layered thermal insulating piston cap using a perforated metal sheet layer.

2. Description of the Prior Art

Internal combustion engines manufactured today have less weight and higher operating temperatures than engines produced a few years ago. The purpose of this is to improve efficiency while assuring minimal emissions. In order to reduce weight, automobile manufacturers have turned to engine components manufactured from low weight castable metals, such as aluminum. Because of the high combustion temperature in these engines which can deleteriously affect the castable metals used for pistons, it is known in the art to provide a thermal insulating cap on the piston head in order to make it more resistant to thermal stresses encountered during engine operation. Various attempts have been made in the prior art to solve the problem of preserving castable metal pistons under the extreme operating conditions of modern internal combustion engines by providing a heat resisting skin for the piston head.

One type of solution, represented by Mitchell et al, U.S. Pat. Nos. 4,245,611 Sander et al, 4,495,684 and Mizuhara, 4,590,901 is to utilize a ceramic material cap or insert on the piston head. Mitchell et al. disclose the use of a recess in a central portion of the piston head for receiving a ceramic insert. Sander et al disclose a recess in the center of the piston head for receiving a composite component consisting of a potshaped inner part of ceramic and an annular outer part made of steel. Mizuhara discloses a piston head having an outwardly opening axial cavity in which a ceramic member is disposed. These solutions suffer from difficulties of adherence of the ceramic to the piston metal. Importantly, ceramics suffer from a tendency towards gradual flaking and, more catastrophically, cracking and fragmenting which can lead to significantly shortened engine life. These problems are exacerbated by the difference in thermal coefficients between the ceramic and the piston metal and the constant vibration and shock inherent in internal combustion engines.

Another type of solution, represented by Nagumo, U.S. Pat. Nos. 4,254,621 Kohnert et al., 4,334,507 Guenther, 4,546,048 and Kervagoret, 4,550,707 is to utilize a metal mesh insulating layer on the piston head. Nagumo discloses a platy block made of nickel based alloy having a porous or intersticed structure over its entire thickness which is embedded in surface regions of an internal combustion engine exposed to combustion processes. Kohnert et al disclose a piston head which has a heat and wear resistant metal cladding having a porous mesh anchoring undersurface, for ensuring that when the piston is cast, metal penetrates the pores of the mesh. Guenther discloses a composite thermal piston head shield consisting of an exposed layer of heat resistant metal and a layer underneath of permeable metal, such as filamentary metal mesh. Kervagoret discloses a hollow piston head having a casing lining the hollow portion of the piston and an exterior mesh supported by a planar annular rim across the top of the piston; the mesh, which is intended to let air flow therethrough, is welded to the casing and both the casing and the mesh are made of a nickel based alloy material.

FIG. 1 shows the current state of the art in metal mesh type piston caps for insulating an automotive piston using a coined blank 10, made from the following materials: a top sheet 12 of 0.025 inch number 304 stainless steel, mesh insulating layers 14 for providing a dead air space, a 0.007 inch metal foil layer 16 for providing an airtight seal against the mesh layers, thereby preventing molten aluminum from flooding the mesh when the piston is cast, and additional mesh layers 18 to provide an anchor into the aluminum of the piston. The various layers are diffusion bonded to form an inseparable composite material. Sheets of this composite are then blanked into circles and then coined to the required geometry for use as a piston cap. Generally, the preferred geometry of a piston cap 22 has a deep draw 24, as shown perspectively in FIG. 2 and cross-sectionally in FIG. 3.

Solutions utilizing a metal mesh for providing protective caps on cast metal pistons suffer from a variety of problems. The problems relate to the need to accommodate the properties of the insulating mesh layer with the requirements of piston casting and the extreme environmental conditions encountered during engine operation. The most notable of these problems will now be discussed.

Since the dead air space of the insulating layer of the mesh is continuous, it must be sealed from the top, bottom and on the perimeter to prevent molten aluminum intrusion during pressure casting of the piston. The top and bottom are sealed, respectively, by diffusion bonding to the top sheet and the foil. The perimeter is sealed by tungsten inert gas (TIG) welding of a bead 26 on the lip end 28 of the coined blank, shown in FIG. 3 and in greater detail in FIG. 4. This procedure is very costly.

Also, during coining of the piston caps, there is a tendency for the mesh to rupture the thin foil, thereby making the insulating layer permeable. This problem exists because the thin foil is supported only intermittently on both sides of the relatively small and spaced contact "flats" in the mesh.

Yet another problem occurs after pressure casting of the piston. The piston is finish machined to true the outer diameter walls and machine the piston ring grooves. During this machining, the top sheet is often made very thin in a spot or spots due to an off center relationship between the piston cap and the piston. During normal thermal cycling of the engine, these spots in the piston cap skin can serve as stress concentration sites, becoming the nucleation point for fatigue cracks in the stainless steel of the top sheet. Once the top sheet has ruptured, combustion gases enter the dead air space of the insulating mesh, at best reducing thermal insulation and at worst causing the top layers to fragment off, resulting in engine failure.

Accordingly, what is needed is a piston cap for cast metal pistons which is durable, insulative and inexpensive.

SUMMARY OF THE INVENTION

The present invention solves the problems associated with the use of insulating mesh piston caps by substituting a heat and corrosion resistant perforated metal sheet layer for the insulating mesh layer. By using a perforated metal sheet layer between the top sheet and the thin foil, sufficient dead air space is provided to result in good thermal insulation and the thin foil becomes resistant to tearing because there is greater contact area between the thin foil and the perforated metal sheet. Also, there is no need to TIG weld the perimeter of the coined piston caps since the perforated metal sheet does not form a continuous porous network. Indeed, during machining of the castings to final O.D. dimensions, there may be a region of holes in the perforated metal sheet that will be damaged; however, neighboring holes will be unaffected thereby and will maintain their dead air space insulating properties. Finally, one blanked and coined piston cap can be used for a variety of piston sizes since the piston cap does not require forming of the perimeter to fit a particular piston. All of these advantages save considerably on tooling and material costs.

Accordingly, it is an object of the present invention to provide a piston cap which is durable under the extreme environmental conditions present in the combustion chamber of an internal combustion engine.

It is a further object of the present invention to provide a piston cap that has a nonporous insulating layer which gives strength and support to piston cap layers on either side thereof and which does not have to be sealed at its periphery.

It is a further object of the present invention to provide a piston cap which is easier and less expensive to manufacture than mesh insulating layer piston caps.

These and other objects, advantages, features, and benefits of the invention will become apparent from the following specification.

DETAILED DESCRIPTION OF THE PREFERRED EMBODIMENT

Figure 1:
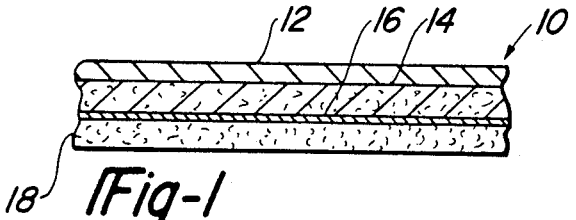
Fig-1 PRIOR ART
FIG. 1 is a cross-sectional view of a prior art piston cap before blanking and coining.
Figure 2:
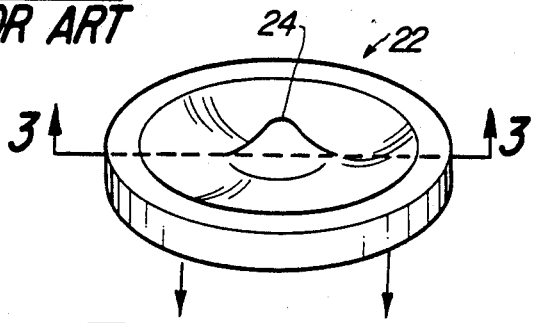
Fig-2 PRIOR ART
FIG. 2 is a perspective view of a prior art piston cap after blanking and coining.
Figure 3:
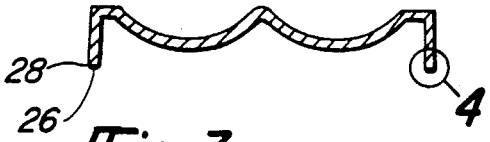
Fig-3 PRIOR ART
FIG. 3 is a cross-sectional view of the prior art piston cap along lines 3—3 in FIG. 2.
Figure 4:
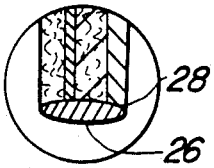
Fig-4 PRIOR ART
FIG. 4 is a detailed cross-sectional view of a lip end weld on the prior art piston cap at an enlarged scale of that depicted in circle 4 of FIG. 3.
Figure 5:
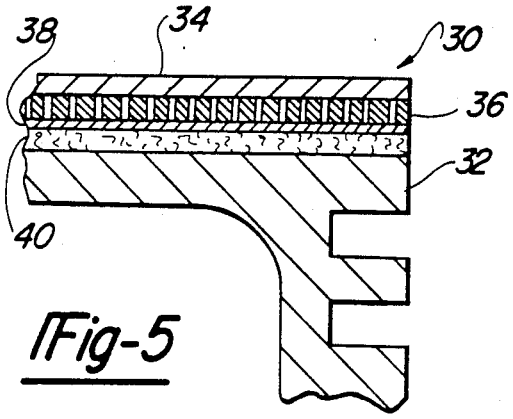
FIG. 5 is a fragmentary cross-sectional view of a piston cap according to the present invention.

Referring now to the figures, FIG. 5 shows a piston cap 30 according to the present invention attached to a cast metal piston 32. The cast metal piston 32 is of the type made of aluminum or aluminum alloy. The piston cap 30 is intended for providing both heat and wear protection to the cast metal piston 32 under operating conditions of the internal combustion engine in which the piston reciprocates.

The piston cap 30 has a top sheet 34 made of a heat and corrosion resistant metal sheet on the order of 0.025 inches thick. Suitable materials therefor include stainless steel, which is preferred, cobalt, nickel or chromium alloys. This component of the piston cap serves to provide an airtight skin protection for a perforated metal sheet 36.

Immediately below the the top sheet 34 is the perforated metal sheet 36 made of a noncorrosive and heat resistant material selected from the metals recited above for the top sheet 34 which is on the order of 0.025 inches thick. The perforations are preferred in the form of holes 0.040 inches in diameter and 0.066 inches between centers. Theholes are preferably arranged in a straight pattern, 29% open. The perforated metal sheet 36 serves to provide a plurality of dead air spaces via the holes to reduce thermal effects of engine combustion on the cast metal piston 32.

Immediately below the perforated metal sheet 36 is a thin metal foil layer 38 made from a material selected from the metals recited above for the top sheet 34. The thin metal foil layer 38 is on the order of 0.007 inches thick. The thin metal foil layer 38 provides an airtight seal for the perforated metal sheet 36, and also serves as a barrier when the piston is cast so as to prevent molten aluminum from filling the perforation holes of the perforated metal sheet 36.

Between the thin metal foil layer 38 and the cast metal piston 32 is located a metal mesh 40 made preferably of the materials recited above for suitable use with the top sheet 34 and fabricated into a wiry, porous intertwined structure. An example of a suitable mesh is $60\times60\times0.0075$ with 0.0092 inch opening width. The metal mesh 40 is used to anchor the piston cap 30 to the cast metal piston 32 which occurs when the piston is cast and aluminum is allowed to run freely into the pores of the metal mesh 40.

Each of the layers, the top sheet 34, the perforated metal sheet 36, the thin metal foil layer 38, and the metal mesh 40 are diffusion bonded to form an inseparable multi-layer unit. Once bonded, the inseparable multi-layer unit is then blanked and coined to form the piston cap 30.

Figure 6:
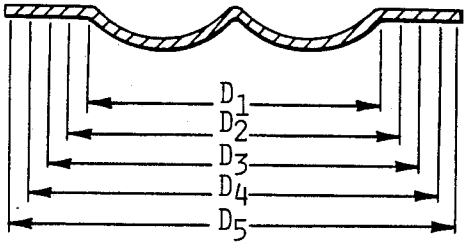
FIG. 6 is a schematic cross-sectional view of the piston cap according to the present invention.

FIG. 6 shows how the present invention allows for making a variety of sized piston caps from the same inseparable multi-layer unit. Because there is no lip, as was required in the prior art piston cap of FIGS. 1 through 4, the inseparable multi-layer unit of the present invention can be blanked to any convenient cross-sectional size, shown as D-1 through D-5 in the figure, using only one coining geometry, without any need of periphery TIG welding.

To those skilled in the art to which this invention appertains, the above described preferred embodiment may be subject to change or modification. Such changes or modifications can be carried out without departing from the scope of the invention, which is intended to be limited only by the scope of the appended claims.

What is claimed is:

1. A multi-layer piston cap for a castable internal combustion engine piston, comprising:

an exterior layer formed of a continuous metal sheet;

a first single piece metal sheet layer having a plurality of separated perforations, said first single piece metal sheet layer being bonded to said exterior layer;

a second metal sheet layer formed of a continuous metal sheet, said second metal sheet being bonded to said first metal sheet; and a mesh layer formed of a porous metal structure, said mesh layer being bonded to said second metal sheet.

2. The multi-layer piston cap of claim 1 wherein each said metal of each of said layers is selected from the group consisting of stainless steel, cobalt, nickel and chromium alloys.

3. The multi-layer piston cap of claim 1, wherein each said bond between each of said layers is a diffusion bond.

4. The multi-layer piston cap of claim 1, wherein said first single piece metal sheet layer is made of a metal selected from the group consisting of stainless steel, cobalt, nickel and chromium alloys, and said plurality of separated perforations are holes in a substantially 29% open straight pattern.

5. A multi-layer piston cap for a castable internal combustion engine piston, comprising:

a first layer made of a noncorrosive and heat resistant metal, said first layer being in the form of a continuous metal sheet;

a second single piece layer bonded to said first layer, said second single piece layer being made of a noncorrosive and heat resistant metal, said second single piece layer having a plurality of spaced apart holes;

a third layer bonded to said second single piece layer, said third layer being made of a noncorrosive and heat resistant continuous metal foil; and a fourth layer bonded to said third layer, said fourth layer being made of a noncorrosive and heat resistant metal, said fourth layer being in the form of a metal mesh having a porous structure.

6. The multi-layer piston cap of claim 5 wherein each said metal of each of said layers is selected from the group consisting of stainless steel, cobalt, nickel and chromium alloys.

7. The multi-layer piston cap of claim 5 wherein each said bond between each of said layers is a diffusion bond.

8. The multi-layer piston cap of claim 5 wherein said second single piece layer is made of a metal selected from a group consisting of stainless steel, cobalt, nickel and chromium alloys, and said plurality of spaced apart holes are in a substantially 29% open straight pattern.

* * * * *

UNITED STATES PATENT AND TRADEMARK OFFICE

CERTIFICATE OF CORRECTION

PATENT NO. : 4,863,807

DATED : September 5, 1989

INVENTOR(S) : Stephen Krasicky, Jr.

It is certified that error appears in the above-identified patent and that said Letters Patent is hereby corrected as shown below:

Title page, Abstract, line 10, delete "or" and insert ---- of

Column 1, line 53, delete "al.," and insert ---- al, ----.

Column 4, line 4, delete "Theholes" and insert ---- The holes

Signed and Sealed this

Nineteenth Day of February, 1991

*Attest:*

HARRY F. MANBECK, JR.

*Attesting Officer*

*Commissioner of Patents and Trademarks*